US011753279B2

(12) United States Patent
Wang et al.

(10) Patent No.: US 11,753,279 B2
(45) Date of Patent: Sep. 12, 2023

(54) VEHICLE FRAME, AERIAL TRANSPORTATION VEHICLE, AND AERIAL RAIL CONTAINER TRANSPORTATION METHOD

(71) Applicant: CRRC YANGTZE CO., LTD., Wuhan (CN)

(72) Inventors: Quanhu Wang, Wuhan (CN); Lijie Su, Wuhan (CN); Aiwen Liu, Wuhan (CN); Heng Huang, Wuhan (CN); Shaobo Song, Wuhan (CN); Wei Liu, Wuhan (CN); Zhiguo Chen, Wuhan (CN); Jianyun Hou, Wuhan (CN); Zixun Wang, Wuhan (CN); Xiong Yao, Wuhan (CN); Hui Luo, Wuhan (CN); Can Cui, Wuhan (CN); Ye Feng, Wuhan (CN)

(73) Assignee: CRRC YANGTZE CO., LTD., Wuhan (CN)

( * ) Notice: Subject to any disclaimer, the term of this patent is extended or adjusted under 35 U.S.C. 154(b) by 88 days.

(21) Appl. No.: 17/594,861

(22) PCT Filed: Jul. 28, 2020

(86) PCT No.: PCT/CN2020/105224
§ 371 (c)(1),
(2) Date: Nov. 1, 2021

(87) PCT Pub. No.: WO2021/135194
PCT Pub. Date: Jul. 8, 2021

(65) Prior Publication Data

US 2022/0212900 A1 Jul. 7, 2022

(30) Foreign Application Priority Data

Dec. 31, 2019 (CN) ..... 201911417664.7
Dec. 31, 2019 (CN) ..... 201911423648.9

(51) Int. Cl.
*B66C 11/00* (2006.01)
*B66C 11/04* (2006.01)
(Continued)

(52) U.S. Cl.
CPC ..... *B66C 11/04* (2013.01); *B66C 1/101* (2013.01); *B66C 9/02* (2013.01); *B66C 19/00* (2013.01)

(58) Field of Classification Search
CPC ..... B66C 1/101; B66C 1/223; B66C 1/663; B66C 11/04; B66C 19/00; B66C 19/02;
(Continued)

(56) References Cited

U.S. PATENT DOCUMENTS 6,826,452 B1 * 11/2004 Holland ..... B66C 23/00 318/568.22
7,267,240 B2 * 9/2007 Maurer ..... B66C 13/063 212/270
(Continued)

FOREIGN PATENT DOCUMENTS

CN 111055855 A * 4/2020 ..... B61B 3/02
DE 2603679 A1 8/1977
(Continued)

OTHER PUBLICATIONS

First Office Action by the CNIPA of the prior Chinese application No. 201911417664.7 dated Jul. 28, 2020, with English translation.

*Primary Examiner* — Emmanuel M Marcelo
(74) *Attorney, Agent, or Firm* — Platinum Intellectual Property

(57) ABSTRACT

The disclosure relates to an aerial transportation vehicle including a vehicle frame. The vehicle frame includes an upper vehicle frame (3); a lower vehicle frame (4); lifting assembly (a), at least two lifting assemblies (a) opposite to each other being provided in a first direction, and the lower
(Continued)

vehicle frame (4) and the upper vehicle frame (3) may be made to move close to or away from each other by operating at least two lifting assemblies (a); a locking device (b), the locking device (b) being disposed on the lower vehicle frame (4); when the lower vehicle frame (4) and the upper vehicle frame (3) move close to each other, the lower vehicle frame (4) and the upper vehicle frame (3) may be locked together by operating the locking device (b); a guide device (d), the guide device (d) being disposed on the lower vehicle frame (4); when the lower vehicle frame (4) and the upper vehicle frame (3) are separated from each other, the containers of different specifications may be quickly assembled and connected onto the lower vehicle frame (4) by operating the guide device (d). The disclosure can realize the assembly and connection of the containers with the aerial transportation vehicle by means of the devices of the aerial transportation vehicle itself with a simple operation. In addition, the disclosure also relates to an aerial rail container transportation method.

10 Claims, 7 Drawing Sheets

(51) Int. Cl.

| | |
|---|---|
| ***B66C 9/02*** | (2006.01) |
| ***B66C 19/00*** | (2006.01) |
| ***B66C 1/10*** | (2006.01) |

(58) Field of Classification Search
CPC ..... B61B 3/02; B61B 45/007; B61B 47/00; B66D 1/12
See application file for complete search history.

(56) References Cited

U.S. PATENT DOCUMENTS

| | | | | |
|---|---|---|---|---|
| 10,737,915 | B2 * | 8/2020 | Mohr | B66C 13/06 |
| 2009/0257853 | A1 * | 10/2009 | Marston | B66F 9/186 414/425 |

FOREIGN PATENT DOCUMENTS

| | | | | |
|---|---|---|---|---|
| EP | 1640309 | A1 * | 3/2006 | B66C 1/101 |
| JP | H04121394 | A | 4/1992 | |

* cited by examiner

VEHICLE FRAME, AERIAL TRANSPORTATION VEHICLE, AND AERIAL RAIL CONTAINER TRANSPORTATION METHOD

CROSS-REFERENCE TO RELATED ART

This application is a United States National Stage Application filed under 35 U.S.C 371 of PCT Patent Application Serial No. PCT/CN2020/105224, filed Jul. 28, 2020, which claims the priority of China Patent Application No. 201911417664.7 filed on Dec. 31, 2019, entitled "Aerial Rail Container Transportation Method" and China Patent Application No. 201911423648.9, filed on Dec. 31, 2019, entitled "vehicle frame and aerial transportation vehicle", which are incorporated herein by reference with their entirety, the disclosure of all of which are hereby incorporated by reference in their entirety.

TECHNICAL FIELD

The disclosure belongs to the field of logistics and transportation, and in particular, to a vehicle frame, aerial transportation vehicle, and aerial rail container transportation method.

BACKGROUND OF THE INVENTION

At present, China's port collection and distribution system mainly relies on road transportation (up to 84%). However, the road transportation involves high pollution to environment, high transportation cost, and especially the connection for the last kilometer to the container port has become a primary problem in the development of comprehensive transportation system in China.

In order to solve the above technical problems, aerial rail transportation equipment applied to port container logistics has appeared. The aerial rail transportation line may span road, river, factory, etc. to solve the problem of the last kilometer transportation of containers.

In the process of implementing the disclosure, the applicant found that there are at least the following shortages in the existing aerial rail transportation of containers.

In the prior art, the container is firstly lifted through a ground jacking device to connect and assemble to a vehicle body of an aerial transportation vehicle, which requires an external jacking device to achieve the connection and assembly of the container and the vehicle body. In operation, a jacking device needs to be moved to a fixed position for connection to the vehicle body. Then the container is hoisted to the jacking device, and then the jacking device is operated to connect and assemble the container to the vehicle body. After the connection and assembly of all the containers to the vehicle body are completed, it is necessary to remove the jacking device. The operating process is very cumbersome.

SUMMARY OF THE INVENTION

To address the problems in the prior art, the disclosure provides a vehicle frame, an aerial transportation vehicle including the vehicle frame and an aerial rail container transportation method using the aerial transportation vehicle to solve the problem in the prior art that the operating process of aerial rail transportation of container is cumbersome.

In one aspect of the disclosure, a vehicle frame is provided including: an upper vehicle frame; a lower vehicle frame; a lifting assembly, at least two lifting assemblies being disposed opposite to each other in a first direction, the lower vehicle frame and the upper vehicle frame being able to move close to or away from each other by operating the at least two lifting assemblies; a locking device disposed on the lower vehicle frame, the lower vehicle frame and the upper vehicle frame being able to be locked with each other by operating the locking device when the lower vehicle frame and the upper vehicle frame are close to each other; and a guide device, the guide device being disposed on the lower vehicle frame, containers of different specifications being able to be quickly assembled and connected with the lower vehicle frame by operating the guide device when the lower vehicle frame and the upper vehicle frame are separated from each other.

In some embodiments, each lifting assembly may include a lifting motor, a wire rope, and a movable pulley; and two lifting motors are disposed opposite to each other in a second direction, the two lifting motors both being fixedly provided on the upper vehicle frame, and the second direction being perpendicular to the first direction. The movable pulley and the lifting motor are provided correspondingly in one-to-one relation, and two movable pulleys are rotatably disposed on the lower vehicle frame in the second direction. The wire rope and the lifting motor as well as the movable pulley are provided correspondingly in one-to-one relation, and the wire rope have a first end and a second end. The first end of the wire rope is wound on an output end of a corresponding lifting motor, and the second end of the wire rope is wound on a corresponding movable pulley.

In some embodiments, each lifting assembly includes two fixed pulleys corresponding to the wire rope. The two fixed pulleys are disposed opposite to each other in the second direction and between the two lifting motors, and the two fixed pulleys are both rotatably disposed on the upper vehicle frame. The second ends of the two wire ropes respectively pass around corresponding movable pulleys and corresponding fixed pulleys sequentially and the second ends of the two wire ropes are joined together.

In some embodiments, a tension sensor may be provided on the two wire ropes joined together, and the tension sensor may be disposed between the two fixed pulleys.

In some embodiments, an output shaft of each of the lifting motors may be fixedly provided with a reel, and the first end of the wire rope is wound around the reel of a corresponding lifting motor.

In some embodiments, the locking device may include a rotary pin; a locking head, fixedly provided on a head of the rotary pin; a rotary handle fixedly disposed on the bottom of the rotary pin, and the rotary handle is formed with a first limit face and a second limit face spaced apart from each other on its periphery; a lifting pin, a central axis of the lifting pin and a central axis of the rotary pin being parallel with each other, the lifting pin operably moving up and down along the central axis of the lifting pin, and the lifting pin being provided with a support protrusion thereon; a limit block fixedly provided on the bottom of the lifting pin, the limit block being operably engaged with the first limit face or the second limit face; a reset spring, the reset spring being fitted on the lifting pin, and the reset spring being disposed between the support protrusion and the limit block; a driving mechanism, an output end of the driving mechanism being connected to the rotary handle, and the rotary handle being able to be rotated by operating the driving mechanism. The upper vehicle frame may include a first cover plate, the first cover plate being located at the bottom of the upper vehicle frame, the first cover plate being formed with a lock hole, the locking head of the locking device being rotatable in the lock hole, The lower vehicle frame may include a second cover plate and a partition spaced apart from each other, and the second cover plate and the partition are fixedly connected to each other. The second cover plate may be located at the top of the lower vehicle frame, and the partition may be located below the second cover plate. Each of the second cover plate and the partition may be formed with a first through hole corresponding to the rotary pin of the locking device, and the rotary pin may be fixedly passing through corresponding first through holes in the second cover plate and the partition. The rotary handle may be located below the partition. The second cover plate and the partition each may be formed with a second through hole corresponding to the lifting pin of the locking device. The lifting pin may be extendable and retractable in the second through holes in the second cover plate and the partition, and the reset spring may be disposed between the support protrusion and the partition.

In some embodiments, a locking seat and a carrying table may be provided separately on the rotary pin, and the locking seat and the carrying table are sequentially disposed between the locking head and the rotary handle. A first gap may be formed between the locking head and the locking seat, and the second cover plate is clamped in the first gap. A second gap may be formed between the carrying table and the rotary handle, the partition being clamped in the second gap, and the locking seat and the carrying table are fitted with each other with spherical surfaces.

In some embodiments, the locking device may further include a sleeve, and the sleeve is fixedly disposed at the bottom of the partition. The lifting pin is extendable and retractable in the sleeve, and the limit block may be located under the sleeve.

In some embodiments, the lower vehicle frame may include a second longitudinal beam, a third cross beam and a fourth cross beam. Central portions of the third cross beam and the fourth cross beam are fixed on the second longitudinal beam, and there may be two third cross beams and two fourth cross beams opposite to each other. The two fourth cross beams may be located at two ends of the second longitudinal beam, and the two third cross beams may be located between the two fourth cross beams. The guide device may include a first guide plate, a second guide plate, and a third guide plate. The third cross beams and the fourth cross beams each may be provided with the first guide plates opposite to each other at two ends thereof, and the two first guide plates on each of the third cross beams and the fourth cross beams may be disposed transversely. The guide surfaces of the two first guide plates on each of the third cross beams and the fourth cross beams may face each other. Each of the third cross beams may be provided with the second guide plate, and the second guide plates on two third cross beams are opposite to each other along the longitudinal direction. The guide surfaces of the second guide plates on two third cross beams may face each other, and the second guide plate may be foldably connected to the third cross beam. There are two third guide plates, and the two third guide plates may be disposed at two ends of the second longitudinal beam and are opposite to each other. The guide surfaces of the two third guide plates may face each other, and the third guide plate is extendable and retractable in a length direction of the second longitudinal beam.

In another aspect of the disclosure, an aerial transportation vehicle is provided comprising a vehicle frame mentioned in the disclosure.

In a yet aspect of the disclosure, an aerial rail container transportation method is provide, which is implemented with the aerial transportation vehicle mentioned in the disclosure. The method may comprise: the aerial transportation vehicle being free of load and running to a certain position and stopping, so that the container is located directly below the aerial transportation vehicle; operating the lifting assembly to separate the upper vehicle frame from the lower vehicle frame and lowering the lower vehicle frame to a preset height; completing a locking of the lower vehicle frame with the container; operating the lifting assembly to make the lower vehicle frame and the container rise as a whole; operating the locking device to lock the upper vehicle frame and the lower vehicle frame; and the aerial transportation vehicle being started for transportation after the container assembly process is completed.

The beneficial effects of the disclosure includes at least:

according to the aerial transportation vehicle including the vehicle frame in some embodiments of the disclosure, the upper vehicle frame of the vehicle frame may be hung on the aerial rail by a bogie, and the lower vehicle frame is used for assembly of the container. The lower vehicle frame and the upper vehicle frame can move close to or away from each other by operating at least two lifting assemblies. When the lower vehicle frame and the upper vehicle frame are in a separated state, the container is hoisted to the lower vehicle frame; then when the lower vehicle frame and the upper vehicle frame are close to each other, the locking device is operated to lock the lower vehicle frame and the upper vehicle frame together, thereby achieving assembly and connection of the container with the aerial container transportation vehicle. If the container is to be unloaded, an opposite operation may be conducted. According to the aerial rail container transportation method by virtue of the aerial transportation vehicle of some embodiments of the disclosure, a fast assembly and connection of the aerial transportation vehicle and the container can be made by the devices of the vehicle itself, which is simple in operation, and has a high degree of automation and good practicality.

BRIEF DESCRIPTION OF THE DRAWINGS

In order to more clearly illustrate the technical solutions in the embodiments of the disclosure, the drawings used in the description of the embodiments will be briefly introduced in the following. Apparently, the drawings in the following description are simply some embodiments of the disclosure. For those skilled in the art, it is also possible to obtain other drawings according to these drawings without paying creative labor.

DETAILED DESCRIPTION OF THE INVENTION

The technical solution in the embodiments of the disclosure will be described in conjunction with the drawings in the embodiments of the disclosure. Obviously, the described embodiments are merely some of the embodiments of the disclosure, not all of the embodiments. Other embodiments obtained by one of ordinary skill in the art without inventive labor based on the embodiments in the disclosure are all within the scope of protection of the disclosure.

According to embodiments of the disclosure an aerial transportation vehicle is provided including a vehicle frame to solve the technical problem that the operation for assembly and connection of the container to the vehicle body of the aerial transportation vehicle in the prior art is cumbersome.

According to embodiments of the disclosure, a vehicle frame, an aerial transportation vehicle including the vehicle frame, and an aerial rail container transportation method by using the aerial transportation vehicle are provided to solve the technical problem that the operation for assembly and connection of the container to the vehicle body of the aerial transportation vehicle in the prior art is cumbersome.

Figure 1:
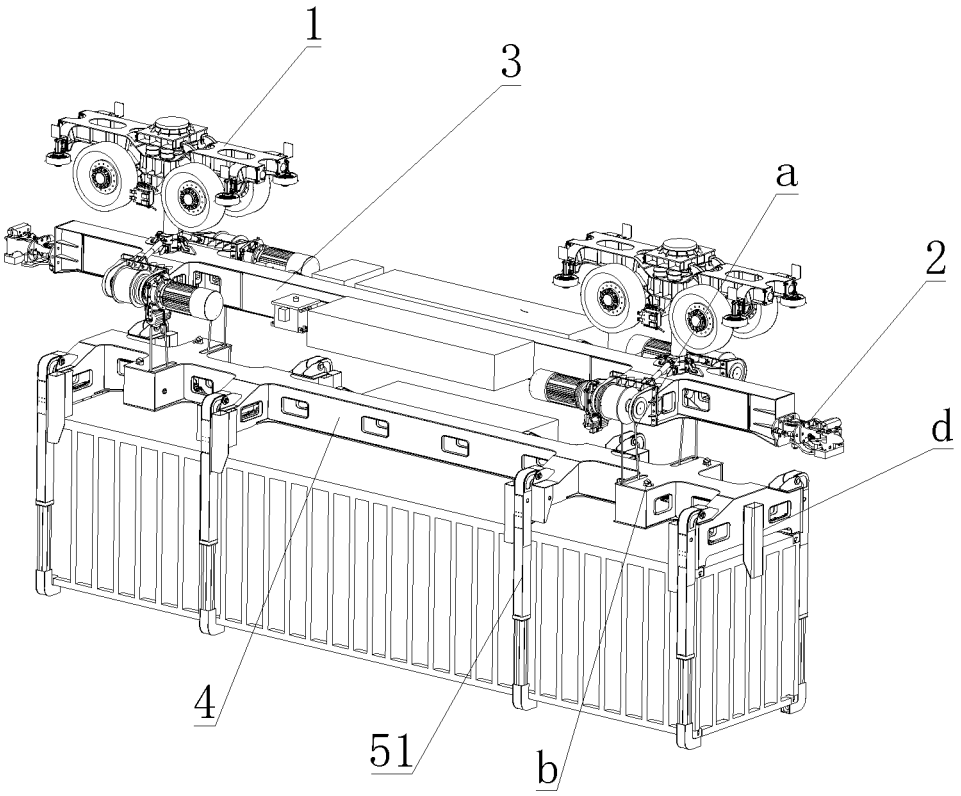
FIG. 1 is a schematic structural diagram of an aerial transportation vehicle in accordance with an embodiment of the disclosure.

FIG. 1 is a schematic structural diagram of an aerial transportation vehicle in accordance with an embodiment of the disclosure. In conjunction with FIG. 1, in some embodiments of the disclosure, the aerial transportation vehicle may include a vehicle frame, a bogie 1, and a coupler draft gear 2. There may be several vehicle frames in order, and each vehicle frame may be equipped with at least two bogies 1, and two adjacent vehicle frames may be connected by the coupler draft gear 2. The bogie 1 may travel on an aerial rail, which can drive multiple vehicle frames to travel on the aerial rail.

In some embodiments of the disclosure, the bogie 1 may be a non-power bogie, which can reduce a weight of the vehicle without affecting the traveling of the vehicle frame in comparison with a bogie having a driving function.

In conjunction with FIG. 1, in some embodiments of the disclosure, the vehicle frame may include an upper vehicle frame 3 and a lower vehicle frame 4. When the vehicle frame is traveling on the aerial rail, the upper vehicle frame 3 and the lower vehicle frame 4 can be locked with each other. When the vehicle frame needs to be assembled with a container, the upper vehicle frame 3 and the lower vehicle frame 4 may be operated so that the two are separated.

Figure 2:
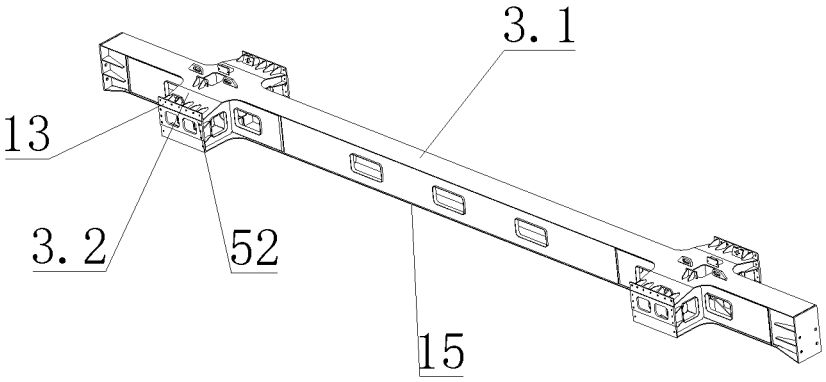
FIG. 2 is a schematic structural diagram of an upper vehicle frame in FIG. 1.

FIG. 2 is a schematic diagram showing the structure of the upper vehicle frame in FIG. 1. In conjunction with FIG. 2, in some embodiments of the disclosure, the upper vehicle frame 3 may be hung on the aerial rail by at least two bogies 1, and may include a first longitudinal beam 3.1 and two first cross beams 3.2, and the two first cross beams 3.2 may be disposed on the first longitudinal beam 3.1 along the length direction of the container.

Figure 3:
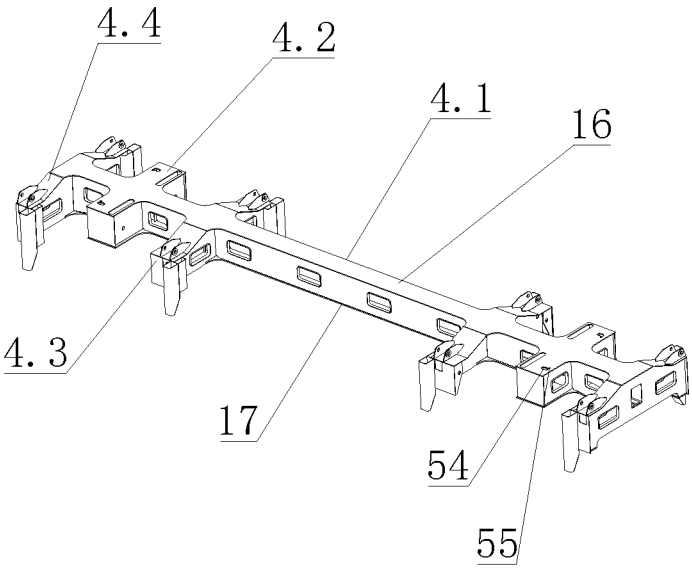
FIG. 3 is a schematic structural diagram of a lower vehicle frame of FIG. 1.

FIG. 3 is a schematic diagram of the structure of the lower vehicle frame of FIG. 1. In connection with FIG. 3, in some embodiments of the disclosure, the lower vehicle frame 4 may include a second longitudinal beam 4.1 and two second cross beams 4.2, and the second longitudinal beam 4.1 may be located directly below the first longitudinal beam 3.1, and the two second cross beams may be located directly below the two first cross beams 3.1, respectively.

In conjunction with FIG. 1, in some embodiments of the disclosure, the vehicle frame may further include a lifting assembly a, and there may be at least two lifting assemblies disposed opposite to each other in a first direction, and the lower vehicle frame 4 and the upper vehicle frame 3 may be moved close to or away from each other by operating the at least two lifting assemblies a.

In some embodiments of the disclosure, the first direction may be the length direction of the container.

Figure 4:
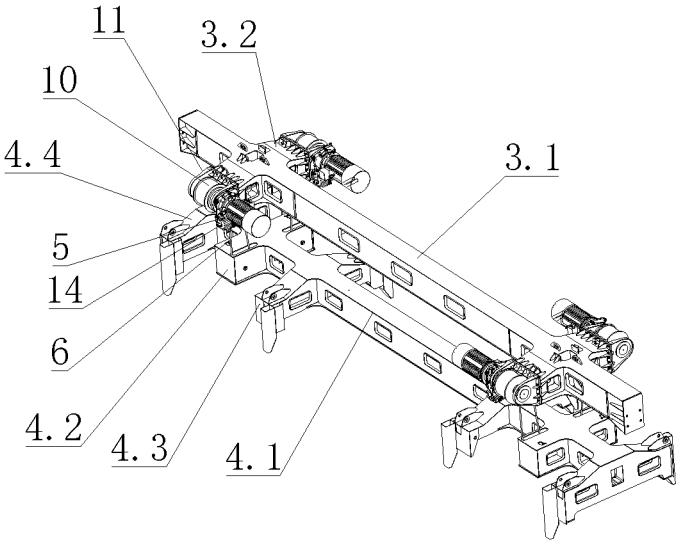
FIG. 4 is a schematic diagram showing an arrangement of lifting assemblies on the vehicle frame in accordance with an embodiment of the disclosure.
Figure 5:
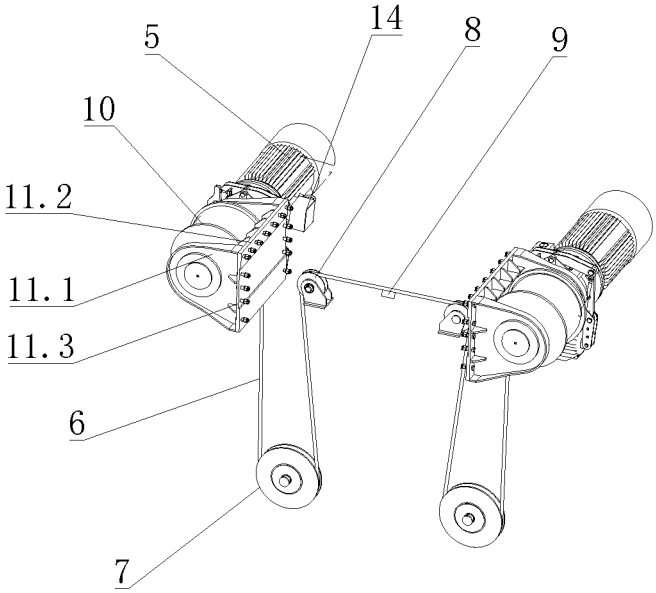
FIG. 5 is a schematic structural diagram of a lifting assembly according to an embodiment of the disclosure.

FIG. 4 is a schematic diagram showing an arrangement of a lifting assembly a on a vehicle frame in accordance with an embodiment of the disclosure. FIG. 5 is a schematic diagram of a structure of the lifting assembly a. In conjunction with FIG. 4 and FIG. 5, in some embodiments of the disclosure, each lifting assembly a may include a lifting motor 5, a wire rope 6, and a movable pulley 7. There may be two lifting motors 5 disposed opposite to each other in a second direction, and both lifting motors 5 may be fixed to the upper vehicle frame 3, and the second direction and the first direction are perpendicular. The movable pulley 7 and the lifting motor 5 may be provided correspondingly in one-to-one relation, and the two movable pulleys 7 may be rotatably disposed on the lower vehicle frame 4 in the second direction. The wire rope 6 and the lifting motor 5 as well as the movable pulley 7 may be provided correspondingly in one-to-one relation, and the wire rope 6 can have a first end and a second end. The first end of the wire rope 6 may be wound on an output end of a corresponding lifting motor 5, and the second end of the wire rope 6 may be wound around a corresponding movable pulley 7.

In some embodiments of the disclosure, the second direction may be in a width direction of the container, and there may be two lifting assemblies a disposed opposite to each other.

In some embodiments of the disclosure, the lower vehicle frame 4 and the upper vehicle frame 3 may be fixedly connected or separated by operating the at least two lifting assemblies a, and thus achieving assembly and connection of the vehicle body of an aerial rail container transportation equipment and the container. The specific operations are: the output end of the lifting motor 5 is controlled to be rotated, so that the wire rope 6 of the same assembly is elongated, thereby lowering the movable pulley 7 of the same assembly to drive the lower vehicle frame 4 to a preset height. After completing the assembly of the container with the lower vehicle frame 4, the output end of the lifting motor 5 may be controlled to rotate in a reverse direction, which enables the wire rope 6 of the same assembly to rise, and thus the movable pulley 7 of the same assembly rises, thereby driving the lower vehicle frame 4 assembled with the container to rise. After the upper vehicle frame and the lower vehicle frame 4 are locked, the assembly and connection of the vehicle frame and the container are completed accordingly. For unloading the container, only contrary operations are needed.

In conjunction with FIG. 4 and FIG. 5, in some embodiments of the disclosure, each lifting assembly a can also include two fixed pulleys 8 corresponding to the wire rope 6. The two fixed pulley 8 may be opposite to each other in the second direction. The two fixed pulleys 8 may be opposite to each other and disposed between the two lifting motors 5, and the two fixed pulleys 8 may be rotatably disposed on the upper vehicle frame 3. The second end of the two wire ropes 6 may be respectively wound around a corresponding movable pulley 7 and a corresponding fixed pulley 8, and the second ends of the two wire ropes 6 may be joined together, so that two lifting motors 5 of the same assembly may be linked and use a wire rope 6 in common. This is for the following reasons: the length of the wire rope may change in use. If each lifting motor has a wire rope, when the wire rope is used for a long time, the lower vehicle frame 4 will be tipped, and there will be an inclination, which is adverse for the locking of the upper vehicle frame 3 and the lower vehicle frame 4 in proximity to each other and is also not conducive to the transportation of the container. In some embodiments of the disclosure, two lifting motors of the same assembly may share a wire rope 6 in common, and thus a self-adaptation can be realized according to the length of the wire rope 6, which can ensure that the two ends of the lower vehicle frame 4 in the longitudinal direction of the container are in the same height. The maximum possible phenomenon happened on the lower vehicle frame 4 is the tipping in the longitudinal direction of the container. Therefore, the tipping of the lower vehicle frame 4 in the longitudinal direction of the container has minimal adverse effects on the locking of the upper vehicle frame 3 and the lower vehicle frame 4 in proximity to each other, the locking of the lower vehicle frame 4 and the container as well as the transportation of the container.

Referring to FIG. 5, in some embodiments of the disclosure, a tension sensor 9 may be provided on the two wire ropes 6 joined together, and the tension sensor 9 may be disposed between the two fixed pulleys 8. The tension sensor 9 can monitor an abnormal state, such as overloading, etc. to ensure the reliability of the assembly and connection of the container with the vehicle body.

In conjunction with FIG. 4 and FIG. 5, in some embodiments of the disclosure, the output shaft of each lifting motor 5 may be fixedly provided with a reel 10, and the first end of the wire rope 6 may be wound on the reel of a corresponding motor. The lifting motor 5 can drive the rotation of the reel 10, and thus it is possible to realize the winding and unwinding of the wire rope 6 on the reel 10.

In some embodiments of the disclosure, the reel 10 can have a reduction box therein, which can reduce a speed of the reel 10, so that a lifting and lowering speed of the lower vehicle frame 4 may be reduced to improve the stability in lifting and lowering the lower vehicle frame 4.

In conjunction with FIG. 4 and FIG. 5, in some embodiments of the disclosure, the upper vehicle frame 3 may be provided with a reel holder 11 corresponding to the reel 10 in on-to-one relation, and the reel 10 is rotatably provided on the corresponding reel holder 11.

In conjunction with FIG. 4 and FIG. 5, in some embodiments of the disclosure, the reel holder 11 may include two opposing support plates 11.1 and a connection plate 11.2, and the same sides of the two support plates 11.1 may be connected by the connection plate 11.2, so that the reel holder 11 has a U-shape in its entirety. The reel 10 may be rotatably disposed on the two support plates 11.1 through a rotary shaft 12. The upper vehicle frame 3 may be provided with a mounting plate 13 corresponding to the reel holder 11, and the mounting plate 13 can be fixedly connected with the connection plate 11.2 of the corresponding reel holder 11 to achieve assembly of the reel holder 11 on the upper vehicle frame 3.

In conjunction with FIGS. 2, 4, and 5, in some embodiments of the disclosure, the connection plate 11.2 may be formed with a groove 11.3 on a side facing away from the support plate 11.1, and the mounting plate 13 may be provided with a projection 52. The projection 52 on the mounting plate 13 may be clamped in the groove 11.3 on the connection plate 11.2 of the corresponding reel holder 11, and the mounting plate 13 and the connection plate 11.2 of the corresponding reel holder 11 can be connected by several bolts to improve the reliability of the assembly of the reel holder 11 on the upper vehicle frame 3.

In some embodiments of the disclosure, two support plates 11.1 and one connection plate 11.2 constituting the reel holder 11 may be integrally formed to improve the strength of the reel holder 11.

Referring to FIGS. 1 and 3, in some embodiments of the disclosure, a brake member 14 may also be provided on the lifting motor 5, and the brake member 14 and the reel 10 can be provided correspondingly in one-to-one relation. The output end of the brake member 14 operably acts on the reel 10. When the lifting motor 5 stops working, an output end of the brake member 6 can act on the reel 10 to prevent the reel 10 from operating again due to the factors such as the gravity of the container and improve safety.

In some embodiments of the disclosure, the brake member 14 may also be provided on the upper vehicle frame 3, and a brake motor can be selected as the brake member 14. In some embodiments of the disclosure, other types of brake devices can also be selected, and the disclosure does not limit this.

In some embodiments of the disclosure, the mounting plate 13 for mounting the reel holder 11 may be disposed on an end of the first cross beam 3.2, and two fixed pulleys 8 of each lifting assembly a may be rotatably provided on the first cross beam 3.2 by respective brackets, and the two movable pulleys 7 of each lifting assembly a may be rotatably provided on the second cross beam 4.2 by respective brackets.

In some embodiments of the disclosure, both a bottom of the upper vehicle frame 3 and a top of the lower vehicle frame 4 may be formed with a through hole corresponding to the wire rope 6 to pass the wire rope 6. The disclosure does not limit the shape of the through hole for passing the wire rope 6.

In some embodiments of the disclosure, a locking device b may be included, and the locking device b may be provided on the lower vehicle frame 4. When the lower vehicle frame 4 and the upper vehicle frame 3 move close to each other, the lower vehicle frame and the upper vehicle frame can be locked to each other by operating the locking device.

Figure 6:
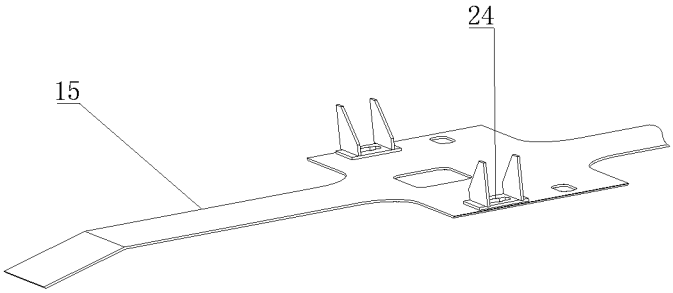
FIG. 6 is a schematic structural diagram of a first cover plate in FIG. 2.

In conjunction with FIG. 2, in some embodiments of the disclosure, there is a first cover plate 15 on the bottom of the upper vehicle frame 3. FIG. 6 is a schematic diagram showing the structure of the first cover plate of FIG. 2. In connection with FIG. 6, in some embodiments of the disclosure, a plurality of lock holes 24 may be formed on the first cover plate 1.

Figure 7:
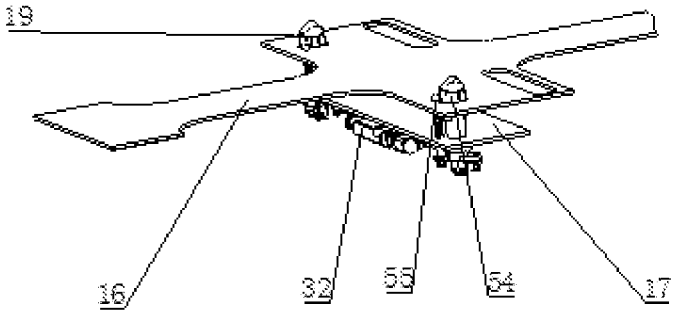
FIG. 7 is a schematic structural diagram of a second cover plate and a partition in FIG. 3.

In connection with FIG. 3, in some embodiments of the disclosure, there is a second cover plate 16 on the top of the lower vehicle frame 4, and there is a partition 17 on the bottom of the lower vehicle frame 4. FIG. 7 is a schematic structural diagram of the second cover plate and the partition in FIG. 3. In connection with FIG. 3 and FIG. 7, in some embodiments of the disclosure, the second cover plate 16 and the partition 17 may be fixedly connected, and the partition 17 may be located below the second cover plate 16.

Figure 8:
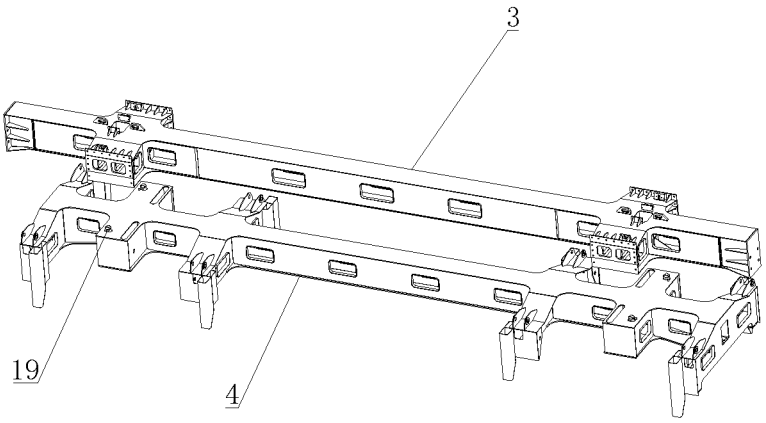
FIG. 8 is a schematic diagram showing an arrangement of a locking device on the vehicle frame in accordance with an embodiment of the disclosure.
Figure 9:
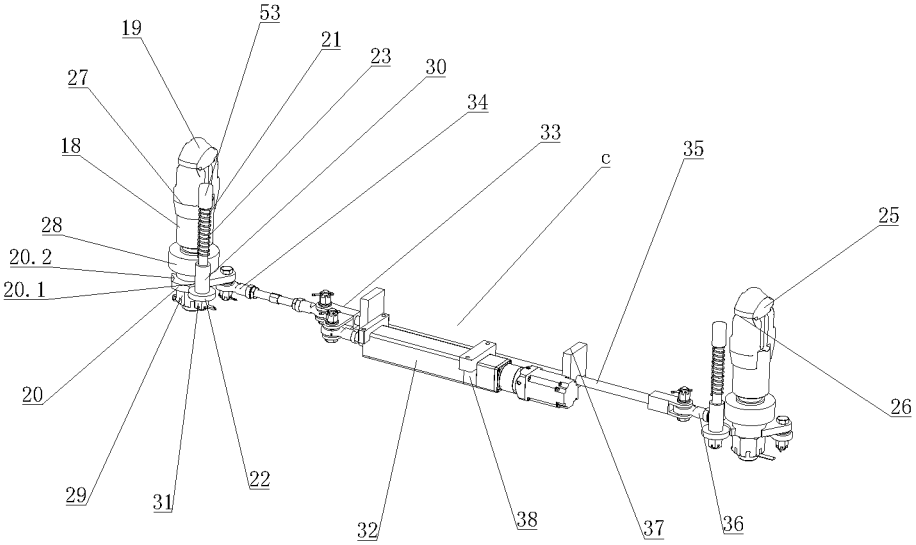
FIG. 9 is a schematic structural diagram of the locking device in FIG. 8.

FIG. 8 is a schematic diagram showing an arrangement of the locking device b on the vehicle frame in accordance with an embodiment of the disclosure. FIG. 9 is a schematic diagram showing the structure of the locking device b in FIG. 8. In connection with FIG. 8 and FIG. 9, in some embodiments of the disclosure, the locking device b can mainly comprise a rotary pin assembly, a fixed pin assembly and a driving assembly.

In conjunction with FIG. 8 and FIG. 9, in some embodiments of the disclosure, the rotary pin assembly may include a rotary pin 18, a locking head 19, and a rotary handle 20. The second cover plate 16 and the partition 17 may be provided with a first through hole 54 corresponding to the rotary pin 18, and the rotary pin 18 can fixedly pass through the corresponding through holes 54 in the second cover plate 16 and the partition 17. The locking head 19 may be fixedly provided on the head of the rotary pin 18, and the locking head 19 is rotatable within the corresponding lock hole 24. The rotary handle 20 may be fixedly provided at the bottom of the rotary pin 18, and the rotary handle 20 may be provided with a first limit face 20.1 and a second limit face 20.2 spaced part from each other on its periphery. The rotary handle 20 may be located below the partition 17.

In conjunction with FIGS. 8 and 9, in some embodiments of the disclosure, the rotary pin assembly may include a lifting pin 21, a limit block 22, and a reset spring 23. The central axis of the lifting pin 21 and the central axis of the rotary pin 18 may be parallel with each other, and the second cover plate 16 and the partition 17 may be formed with a second through hole 55 corresponding to the lifting pin 21. The lifting pin 21 may be extended or retracted in the second through holes 55 in the second cover plate 16 and the partition 17. That is, the lifting pin 21 is operably lifted and lowered along the central axis of the lifting pin 21, and the lifting pin 21 can have a support protrusion 53. The limit block 22 may be fixedly provided at the bottom of the lifting pin 21, and the limit block 22 may be located below the partition 17. The limit block 22 is operably engaged with the first limit face 20.1 or the second limit face 20.2 to lock the rotary handle 20. The reset spring 23 may be fitted on the lifting pin 21, and the reset spring 23 may be disposed between the support protrusion 53 and the limit block 22. In some embodiments of the disclosure, in the lower vehicle frame, the reset spring 23 may be disposed between the support protrusion 53 and the partition 17. That is, the upper end of the reset spring 23 may be connected to the support protrusion 53, and the lower end of the reset spring 23 may be disposed on the partition 17.

In some embodiments of the disclosure, the driving assembly can primarily comprise a driving mechanism c, and an output end of the driving mechanism c can be connected to the rotary handle 20. The rotary handle 20 can be driven to rotate by operating the driving mechanism c.

In some embodiments of the disclosure, when the upper vehicle frame 3 and the lower vehicle frame 4 are needed to be locked, the lower vehicle frame 4 can be controlled to rise by the lifting assembly a, so that the locking head 19 of the rotary pin 18 on the lower vehicle frame 4 can pass through the corresponding lock hole 24 on the upper vehicle frame 3. At this time, the lifting pin 21 is pressed by the upper vehicle frame 3, and the limit block 22 is pressed synchronously, so that the rotary handle 20 on the lower vehicle frame 4 is unlocked. At this time, the reset spring 23 is in a compressed state. The driving mechanism c is operated to drive the rotary handle 20 to rotate a certain angle, and in turn, the locking head 19 also rotates a certain angle, so that the locking head 19 cannot drop off from the lock hole 24 of the upper vehicle frame 3. Then the lower vehicle frame 4 is controlled by the lifting assembly a to be lowered by a small height, and then the reset spring 23 is reset to drive the lifting pin 21 and the limit block 22 to be reset. At this time, the limit block 22 engages the rotary handle 20 so that the rotary handle 20 is mechanically caught by the limit block 22, and thus the upper vehicle frame 3 and the lower vehicle frame 4 are firmly locked. In some embodiments of the disclosure, only contrary operations are needed to separate the upper vehicle frame 3 from the lower vehicle frame 4.

In conjunction with FIG. 9, in some embodiments of the disclosure, the locking head 19 may be provided with two cutting faces 25 opposite to each other and two limit projections 26 opposite to each other on its periphery. The limit projection 26 may be located between the two cutting faces 25. A distance between the two cutting faces 25 may be less than the width of the lock hole 24, and a distance between the two limit projections 26 may be larger than the width of the lock hole 24 and smaller than the length of the lock hole 24. When the rotary pin 18 is in an unlocked state, the locking head 19 can movably extend or retract in the lock hole. When the rotary pin 18 is in a locked state, the two limit projections 26 may be hung on the first cover plate and cannot movably extend or retract in the lock hole 24 to ensure the reliability of the lock.

In conjunction with FIG. 9, in some embodiments of the disclosure, a locking seat 27 and a carrying table 28 may also be provided separately on the rotary pin 18, and the locking seat 27 and the carrying table 28 may be sequentially disposed between the locking head 19 and the rotary handle 20. The locking head 19 and the locking seat 27 may have a first gap therebetween, and the second cover plate 16 may be clamped in the first gap. The carrying table 28 and the rotary handle 20 can have a second gap therebetween, and the partition 17 is clamped in the second gap.

In some embodiments of the disclosure, the locking seat 27 and the carrying table 28 have spherical fit therebetween, that is, the rotary pin 18 is divided into two portions: a first portion is above the locking seat 27 and the carrying table 28 is the second portion. The first portion may be connected with the second cover plate 16 through the first gap between the locking head 19 and the locking seat 27, and the second portion may be connected with the partition 17 through the second gap between the carrying table 28 and the rotary handle 20. At the same time, the locking seat 27 and the carrying table 28 have spherical fit therebetween, that is, the first portion and the second portion can have spherical fit, so that the first portion can float relative to the second portion to adapt to the impact generated when the upper vehicle frame and the lower vehicle frame 4 are locked, which has good practicability.

In some embodiments of the disclosure, the bottom of the locking seat 27 may have a spherical concave surface, and the top of the carrying table 28 may has a spherical convex surface. In some embodiments of the disclosure, a contrary configuration can be used, which is not limited in the disclosure.

In some embodiments of the disclosure, the first through hole 54 in the second cover plate 16 for passing the rotary pin 18 may be a waist shape hole to enable the first portion to have a conical swing in the first through hole 54.

In conjunction with FIG. 9, in some embodiments of the disclosure, the rotary pin 18 may also be provided with a first positioning block 29, and the first positioning block 29 may be fixedly disposed at the bottom of the rotary pin 18. The first positioning block 29 may be disposed close to the rotary handle 20, so that the rotary handle 20 can be locked to ensure a reliable connection of the rotary handle 20.

In some embodiments of the disclosure, the first positioning block 29 may take the form of a transverse bolt or cotter pin, etc., but the disclosure is not limited to this.

In some embodiments of the disclosure, the first limit face 20.1 and the second limit face 20.2 apart from each other on the periphery of the rotary handle 20 may be in the form of a groove, and when the limit block 22 is located in the groove, the rotary handle can be restricted from rotation.

In some embodiments of the disclosure, the first cover plate 15 of the upper vehicle frame 3 may also be formed with a third through hole for passing the head of the lifting pin and thus guiding the movement of the lifting pin 21.

In conjunction with FIGS. 8 and 9, in some embodiments of the disclosure, a lifting pin assembly 30 may also comprise a sleeve 30, and the sleeve 30 may be fixedly provided at the bottom of the partition 17; the lifting pin 21 may be extended and retracted in the sleeve 30, and the limit block 22 is located at a lower portion of the sleeve 30. When the reset spring is reset, the limit block 22 may rest against the bottom of the sleeve 30, that is, the sleeve 30 has a limiting effect to keep the limit block 22 at a predetermined locking position, so as to ensure a reliable lock.

In conjunction with FIG. 9, in some embodiments of the disclosure, the lifting pin 21 may also be provided with a second positioning block 31, and the second positioning block 31 may be fixedly disposed on the bottom of the lifting pin 21. The second positioning block 31 may abut closely against the limit block 22, so that the limit block 22 can be locked to ensure a reliable connection of the limit block 22.

In some embodiments of the disclosure, the second positioning block 31 may take the form of a transverse bolt or cotter pin, etc., and the disclosure is not limited to this.

In some embodiments of the disclosure, the driving mechanism c can drive the rotary handle 20 to rotate by an angle of 90°. In some embodiments of the disclosure, the angle may be set to other angles, which is not limited in the disclosure.

In conjunction with FIG. 9, in some embodiments of the disclosure, the driving mechanism c may include a driving member 32, a first link 33 and a second link 34. An output end of the driving member 32 can make a linear reciprocating movement, and the first link 33 may be L-shaped; the output end of the driving member 32 may be rotatably connected to one end of the first link 33, and another end of the first link 33 is rotatably connected to one end of the second link 34; another end of the second line 34 is rotatably connected to the rotary handle 20. In this way, the rotary handle 20 can be rotated by controlling the operation of the output end of the driving member 32.

In conjunction with FIG. 9, in some embodiments of the disclosure, the driving mechanism c may further comprise a third link 35 and a fourth link 36, and one end of the third link 35 can be connected at a corner of the first link 33 of the corner; another end of the third link 35 can be extended away from the second link 22, and another end of the third link 35 is rotatably connected to one end of the fourth link 36; the fourth link 36 is rotatably connected to another rotary handle 20. In this way, only one driving member 32 is needed to rotate two rotary handles 20, and thus drive two locking devices b.

In some embodiments of the disclosure, two guide plates 37 may be further provided, which are fixedly disposed opposite to each other, and the third link 35 can movably pass through the two guide plates 37, so that the third link 35 can make a linear motion, and thus the fourth link 36 and second link 22 can be miniaturized to optimize the configuration of the lower vehicle frame 4.

In some embodiments of the disclosure, the guide plate 37 may be fixed to the second cover plate 16 and the partition 17 of the lower vehicle frame 4; and the driving member 32 may be fixed on a fixed base 38, and the fixed base 38 may be fixedly provided at the bottom of the second cover plate 16 of the lower vehicle frame 4.

In some embodiments of the disclosure, the driving member can use a servo linear actuator, or other mechanism, such as a hydraulic cylinder, and the disclosure is not limited to this.

In some embodiments of the disclosure, the lower vehicle frame 4 may be provided with a position sensor 22 corresponding to the limit block 22 in one to one relation. When the limit block 22 is lowered to a pre-set position, it can be sensed by a position sensor corresponding to it, and thus the driving member is controlled to work, thereby realizing automatic operation.

In some embodiments of the disclosure, each second cross beam 4.2 may be provided with a locking device b therein, and the driving member of the locking device b can extend and retract in a widthwise direction.

In some embodiments of the disclosure, after a lower vehicle frame 4 and an upper vehicle frame 3 are separated, it is necessary to quickly assemble and connect the lower vehicle frame 4 and the container. In order to achieve fast assembly and connection of the container of different specifications with the lower vehicle frame 4, in some embodiments of the disclosure, the vehicle frame may further comprise a guide device d.

In conjunction with FIG. 3, in some embodiments of the disclosure, the lower vehicle frame 4 may further include a third cross beam 4.3 and a fourth cross beam 4.4. The central parts of the third and fourth cross beams 4.3 to 4.4 may be fixed on the second longitudinal beam 4.1. There may be two third cross beams 4.3 opposite to each other and two fourth cross beams 4.4 opposite to each other; the two fourth cross beams 4.4 can be positioned at two ends of the second longitudinal beam 4.1 and the two third cross beams 4.3 may be located between the two fourth cross beams 4.4.

In conjunction with FIG. 3, in some embodiments of the disclosure, the second cross beam 4.2 can be located between the third cross beams 4.3 and the fourth cross beams 4.4 on the same side.

Figure 10:
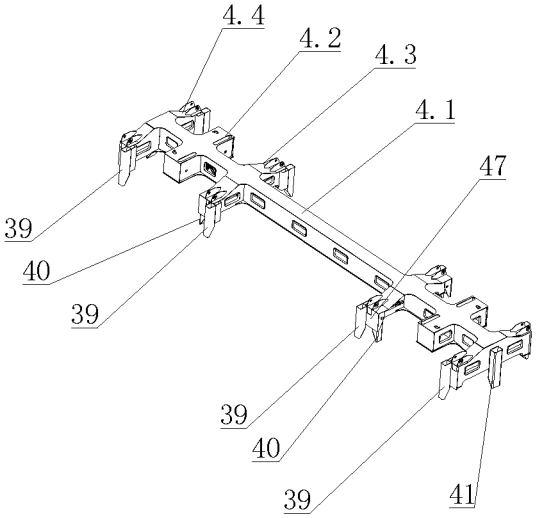
FIG. 10 is a schematic structural diagram of the lower vehicle frame having a guide device in accordance with an embodiment of the disclosure.

FIG. 10 is a schematic structural diagram of the lower vehicle frame 4 having a guide device d according to embodiments of the disclosure. In conjunction with FIG. 10, in some embodiments of the disclosure, the guide device d can primarily comprise a first guide plate 39, a second guide plate 40 and a third guide plate 41.

In conjunction with FIG. 10, in some embodiments of the disclosure, the two ends of each of the third cross beam 4.3 and the fourth cross beam 4.4 may be provided with the first guide plates 39 opposite to each other, and the two first guide plates 39 on each of the second and third cross beams 4.3 and 4.4 can be arranged transversely; and the guide surfaces of the two first guide plates 39 on each of the second and third cross beams 4.3 and 4.4 can be arranged to face each other.

In some embodiments of the disclosure, the spacing between the two first guide plates 39 on each of the second and third cross beams 4.3 and 4.4 can be set as the same as the width of the container.

In some embodiments of the disclosure, the first guide plate 39 may be connected to an end of the third cross beam 4.3 or the fourth cross beams 4.4 by integral forming or welding technique, which is not limited in the disclosure.

In conjunction with FIG. 10, in some embodiments of the disclosure, each of the third cross beams 4.3 is also provided with a second guide plate 40, and the second guide plates 40 on two third cross beams 4.3 may be disposed opposite to each other in a longitudinal direction. The guide faces of the second guide plates 40 on two third cross beams 4.3 may be disposed opposite to each other, and the second guide plate 40 can be foldably connected to the third cross beam 4.3.

Figure 11:
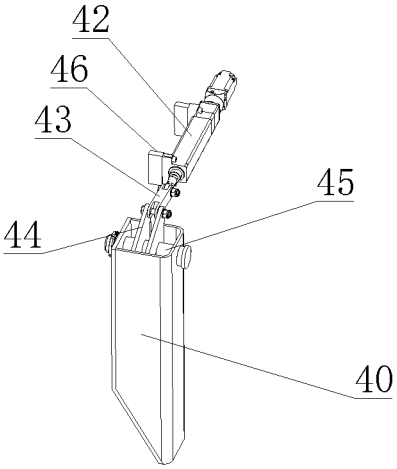
FIG. 11 is a schematic structural diagram of a folding assembly in FIG. 10.

In some embodiments of the disclosure, the second guide plate 40 may be foldably connected to the third cross beam 4.3 by a folding assembly. FIG. 11 is a schematic diagram of a folding assembly 10 in FIG. 10. In conjunction with FIGS. 10 and 11, in some embodiments of the disclosure, the folding assembly may include a first driving member 42, a fifth link 43, a sixth link 44 and a connection shaft 45. The first driving member 42 may be fixedly provided on the body, and an output end of the first driving member 42 may be extended or retracted transversely; each of the fifth link 43 and sixth link 44 may have a first end and a second end opposite to each other, and the first end of the fifth link 43 is rotatably connected to the output end of the first driving member 42; the second end of the fifth link 43 is rotatably connected to the first end of the sixth link 44, and the connection shaft 45 is rotatably provided at an end portion of the third cross beam 4.3; an upper end of the second guide plate 40 is fixedly connected to the connection shaft 45, and the connection shaft 45 is rotatably connected to a second end of the sixth link 44.

In some embodiments of the disclosure, when the first driving member 42 does not work, the second guide plate 40 can be placed in a vertical state to control the output end 7 of the second driving member 7 to extend. The fifth link 43 and the sixth link 44 can drive the connection shaft 45 to rotate, and in turn bring the second guide plate 40 to be folded toward an inner side of the first cross beam. When the second guide plate 40 is in a horizontal state, the first driving member 42 is stopped. That is, in some embodiments of the disclosure, the second guide plate 40 can be driven to be in a vertical or horizontal state by the first driving member 42.

In conjunction with FIG. 10, in some embodiments of the disclosure, the third cross beam 4.3 may be fixedly provided with two first fixing seats 46 therein. The first driving member 42 may be disposed within the third cross beam 4.3, and the first driving member 42 may be fixedly disposed on the two first fixing seats 46 to effect the positioning of the first driving member 42.

In conjunction with FIG. 10, in some embodiments of the disclosure, an end portion of the third cross beam 4.3 may be provided with a limit plate 47, and the limit plate 47 may be located on a non-guide side of the second guide plate 40; the limit plate 47 can limit the second guide plate 40 to be folded toward an outer side of the third cross beam 4.3, so that it can only be folded in accordance with a set mode.

In some embodiments of the disclosure, a distance between the two second guide plates 40 in a horizontal state may be coincident with the longitudinal dimension of a 20 ft container to guide the 20 ft container in its longitudinal direction.

In some embodiments of the disclosure, there may be four second guide plates 40; that is, each of the third cross beams 4.3 may be provided with two second guide plates 40, and the two second guide plates 40 on each third cross beam 4.3 may be located on two sides of the second longitudinal beam 4.1 respectively. That is, four guide plates in a square arrangement are used to guide a 20 ft container in its longitudinal direction.

In conjunction with FIG. 10, in some embodiments of the disclosure, the number of the third guide plates 41 may be two, and the two third guide plates 41 may be provided opposite to each other at two ends of the second longitudinal beam 4.1. The guide surfaces of the two three guide plates 41 face each other, and the third guide plate 41 can be extended or retracted in a longitudinal direction of the second longitudinal beam.

In some embodiments of the disclosure, in an initial state, the distance between the two third guide plates 41 may be coincident with the longitudinal dimension of a 40 ft container to guide the 40 ft container in its longitudinal direction. The third guide plates 41 can be controlled to make the distance between the two third guide plates 41 to be coincident with the longitudinal dimension of a 45 ft container to guide the 45 ft container in its longitudinal direction.

Figure 12:
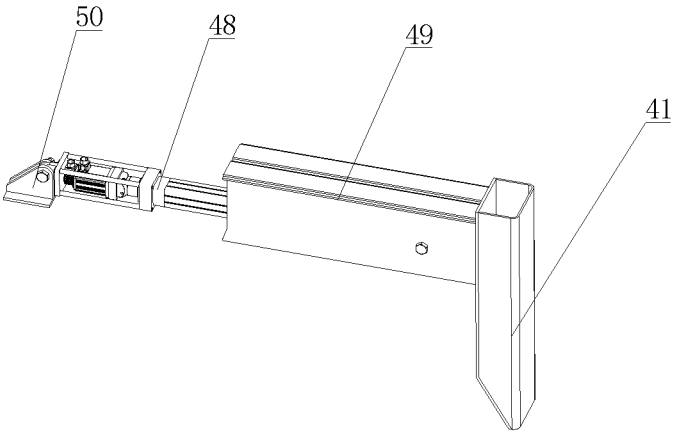
FIG. 12 is a schematic structural diagram of a telescopic assembly in FIG. 10.

In some embodiments of the disclosure, the third guide plate may extend or retract in the longitudinal direction of the longitudinal beam. FIG. 12 is a schematic structural diagram of the telescopic assembly in FIG. 10. In conjunction with FIG. 12, in some embodiments of the disclosure, the telescopic assembly may include a second driving member 48 and a connection beam 49. The second driving member 48 may be fixed on the body, and an output end of the second driving member 48 can be extendable or retractable in the longitudinal direction. The connection beam 49 is slidably disposed on the body, and one end of the connection beam 49 can be fixedly connected to the output end of the second driving member 48. An upper end of the third guide plate 41 may be fixedly provided at another end of the connection beam 49, and a lower end of the third guide plate 41 can be extended vertically and downwardly. Thus, the extension and retraction of the third guide plate 41 can be achieved by controlling the extension and retraction of the output end of the second driving member 48.

In conjunction with FIGS. 10 and 12, in some embodiments of the disclosure, a second fixing seat 50 may be fixedly provided within the second longitudinal beam 4.1 and the second driving member 48 may be disposed in the second longitudinal beam 4.1, and the second driving member 48 can be fixedly connected to the second fixing seat 50.

In some embodiments of the disclosure, a slide slot may be formed on an inner bottom wall of the second longitudinal beam 4.1. The connection beam 4 may be slidably provided in the slide slot so that the connection beams 4 can be guided for movement.

In some embodiments of the disclosure, more of the third guide plates 41 may be provided. Considering space limitations, two third guide plates are preferably in the disclosure.

In some embodiments of the disclosure, a first driving member 42 and the second driving member 48 may select servo linear actuator. In some embodiments of the disclosure, the first driving member 42 and the second driving member 48 may also use other types of reciprocating linear motion, such as a motor or a cylinder and the like. The disclosure does not limit this.

In some embodiments of the disclosure, the guide surfaces of the first guide plate 39, the second guide plate 40 and the third guide plate 41 may all be slanted surfaces, so that the lower vehicle frame 4 and the container may have a deviation within a certain range in a horizontal direction to facilitate the assembly of the lower vehicle frame and the container.

Figure 13:
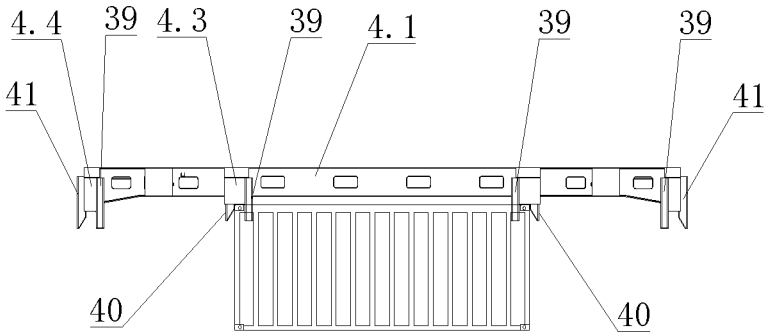
FIG. 13 is a schematic structural diagram showing a lower vehicle frame having a guide device as shown in FIG. 10 hoisting a 20 ft container.

FIG. 13 is a schematic structural diagram showing a lower vehicle frame 4 having a guide device d shown in FIG. 1 lifting a 20 ft container. In conjunction with FIG. 4, in some embodiments of the disclosure, when it is required to lift a 20 ft container, the second guide plate 40 on the third cross beam 4.3 can be controlled to make the second guide plate 40 in a vertical state. When it is required to lower down the lower vehicle frame 4, the first guide plates 39 on two third cross beams 4.3 can be used to guide the 20 ft container in its widthwise direction, and the second guide plates 40 on two third cross beams 4.3 can be used to guide the 20 ft container in its longitudinal direction, so that the lower vehicle frame 4 and the 20 ft container can be quickly locked.

Figure 14:
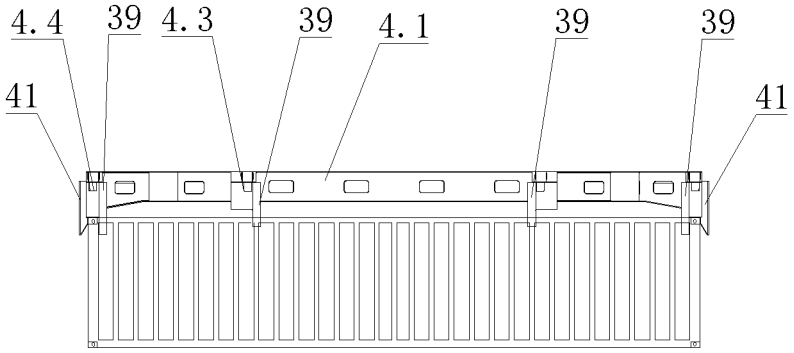
FIG. 14 is a schematic structural diagram showing a lower vehicle frame having a guide device as shown in FIG. 10 hoisting a 40 ft container.

FIG. 14 is a schematic structural diagram showing a lower vehicle frame 4 having a guide device d shown in FIG. 10 lifting a 40 ft container. In conjunction with FIG. 13, in some embodiments of the disclosure, when it is required to lift a 40 ft container, the second guide plates 40 on the third cross beams 4.3 may be controlled to be placed in a horizontal state to prevent interference upon assembling the lower vehicle frame 4 and the 40 ft container. Meanwhile, the third guide plates 41 may be controlled to make the distance between the two third guide plates 41 coincide with the longitudinal dimension of the 40 ft container. The first guide plates 39 on the third and fourth cross beams 4.3 and 4.4 are used to guide the 40 ft container in its widthwise direction, and the two third guide plates 41 are used to guide the 40 ft container in its longitudinal direction, so that the lower vehicle frame 4 and the 40 ft container can be quickly locked.

Figure 15:
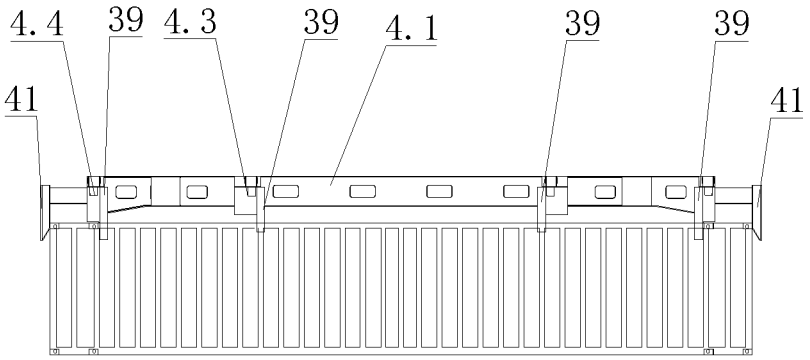
FIG. 15 is a schematic structural diagram showing a lower vehicle frame having a guide device as shown in FIG. 10 hoisting a 45 ft container.

FIG. 15 is a schematic structural diagram showing a lower vehicle frame 4 having a guide device d shown in FIG. 10 lifting a 45 ft container. In conjunction with FIG. 14, in some embodiments of the disclosure, when it is required to lift a 45 ft container, the second guide plates 40 on the third cross beams 4.3 can be controlled to be in a horizontal state to avoid interference upon assembling the lower vehicle frame 4 and the 45 ft container. Meanwhile, the third guide plates 41 can be controlled to make the distance between two third guide plates 41 is consistent with the longitudinal dimension of the 45 ft container. The first guide plates 39 on the third and fourth cross beams 4.3 and 4.4 are used guide the 45 ft container it its widthwise direction, and the two third guide plates 41 are used to guide the 45 ft container in its longitudinal direction so that the lower vehicle frame 4 and the 45 ft container can be quickly locked.

From the above, in some embodiments of the disclosure, the folding of the second guide plate and the extension or retraction of the third guide plate are controlled to adapt to the assembly of the containers of different specifications and the lower vehicle frame 4, which is convenient and fast and has good versatility and practicality.

In some embodiments of the disclosure, the lower vehicle frame 4 and the container can be assembled and connected by a locking assembly. The locking assembly is the same as that used when a container is connected to an aerial vehicle by jacking equipment in the prior art, which is not limited in the disclosure.

In connection with FIG. 1, in some embodiments of the disclosure, a container anti-falling device 51 may be provided at both ends of the third cross beam 4.3. After the lower vehicle frame 4 and the container are assembled, the container anti-falling device can hold the container to improve the safety during container transportation.

In some embodiments of the disclosure, the specific structure of the container anti-falling device may be the same as that disclosed in the application No. "201811638159.0", entitled "Container anti-falling Device", which will not be described in the disclosure.

Figure 16:
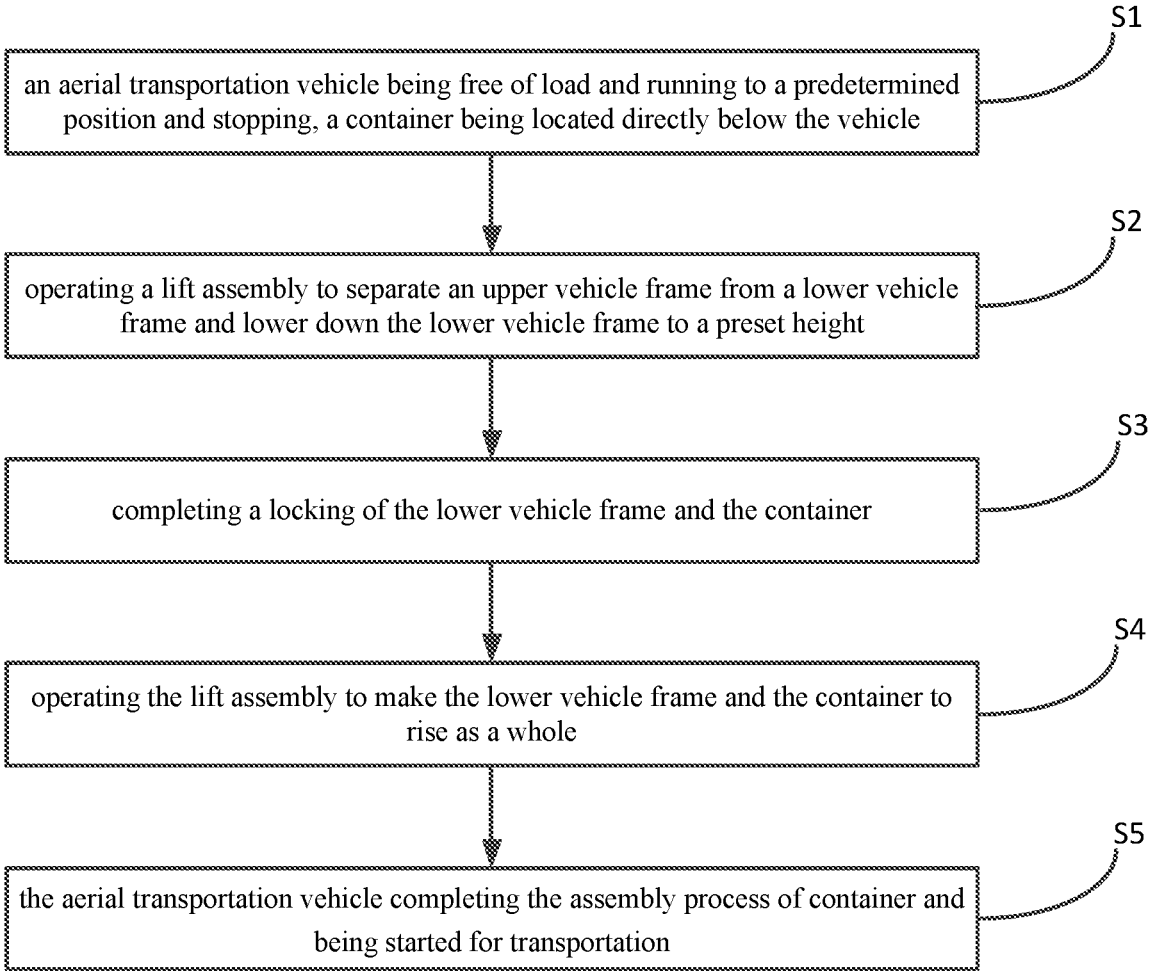
FIG. 16 is a schematic flowchart of an aerial rail container transportation method according to an embodiment of the disclosure.

Based on the above-described aerial transportation vehicle, in some embodiments of the disclosure, an aerial rail container transportation method is also provided. FIG. 16 is a schematic flowchart of an aerial rail container transportation method in accordance with the embodiments of the disclosure. In connection with FIG. 16, in some embodiments of the disclosure, the method may include:

S1: The aerial transportation vehicle being free of load and running to a predetermined position and stopping, at this time, the container is located directly below the vehicle;

S2: Operating the lift assembly a to separate the upper vehicle frame 3 from the lower vehicle frame 4 and lower down the lower vehicle frame 4 to a preset height;

S3: Completing the locking of the lower vehicle frame 4 and the container;

S4: Operating the lift assembly a to make the lower vehicle frame 4 and the container to rise as a whole;

S5: Operating the locking device b to lock the upper vehicle frame 3 and the lower vehicle frame 4 together;

S6: starting the aerial transportation vehicle for transportation after the assembly process of container is completed.

It is to be noted that in some embodiments of the disclosure, the container may be transported and placed directly below the vehicle by a container truck, an AGV vehicle, and a platform such as the ground, and the lower vehicle frame is lowered down to a preset height which is slightly higher than the top of the container.

Figure 17:
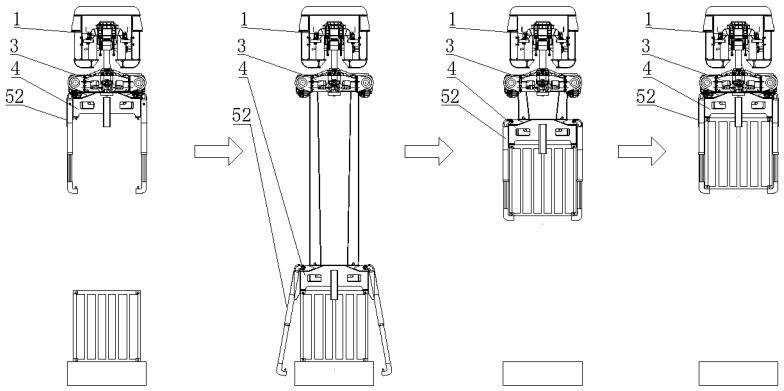
FIG. 17 is a schematic diagram showing an aerial transportation vehicle in accordance with an embodiment of the disclosure hoisting a container.

FIG. 17 is a schematic diagram showing an aerial transportation vehicle in accordance with an embodiment of the disclosure lifting a container. In conjunction with FIG. 17, in some embodiments of the disclosure, the specific steps of lifting a container by an aerial transportation vehicle may include: the aerial transportation vehicle is free of load and runs to a predetermined position and stopped, at this time, the container is located directly below the vehicle; operating the lift assembly a to separate the upper vehicle frame 3 from the lower vehicle frame 4; operating the lift assembly a to lower down the lower vehicle frame 4; opening the container anti-falling device on the lower vehicle frame and opening a guide device d corresponding to the model of the container vehicle; operating a lock between the container and the lower vehicle frame to lock the lower vehicle frame 4 and the container; operating the lift assembly a to make the lower vehicle frame 4 and the container rise as a whole; the container anti-falling device on the lower vehicle frame 4 is shrunk to hold the container; operating the lift assembly a and the locking device b to lock the upper vehicle frame 3 and the lower vehicle frame 4; the aerial transportation vehicle may be started for transportation after the container assembly process is completed. The operating process for unloading containers is contrary to the above process.

In summary, in some embodiments of the disclosure, the aerial transportation vehicles and transportation methods can achieve fast assembly and connection of aerial transportation vehicles with containers through its own devices, which is simple in operation, and has high automation level and good practicability.

The embodiments described above are preferred embodiments of the disclosure, which are only used to facilitate the description of the disclosure rather than limiting the disclosure. Any equivalent embodiments obtained by those of ordinary skill in the art by partially modifying or changing the embodiments of the disclosure based on the content of the disclosure without departing from the technical features of the disclosure all fall within the scope of the disclosure.

The invention claimed is:

1. A vehicle frame comprising:

an upper vehicle frame;

a lower vehicle frame;

a lifting assembly, at least two lifting assemblies being disposed opposite to each other in a first direction, the lower vehicle frame and the upper vehicle frame being able to move close to or away from each other by operating the at least two lifting assemblies;

a locking device disposed on the lower vehicle frame, the lower vehicle frame and the upper vehicle frame being able to be locked with each other by operating the locking device when the lower vehicle frame and the upper vehicle frame are close to each other; and a guide device, the guide device being disposed on the lower vehicle frame, containers of different specifications being able to be quickly assembled and connected with the lower vehicle frame by operating the guide device when the lower vehicle frame and the upper vehicle frame are separated from each other, wherein each lifting assembly includes a lifting motor, a wire rope, and a movable pulley; and two lifting motors are disposed opposite to each other in a second direction, the two lifting motors both being fixedly provided on the upper vehicle frame, and the second direction being perpendicular to the first direction;

the movable pulley and the lifting motor are provided correspondingly in one-to-one relation, and two movable pulleys are rotatably disposed on the lower vehicle frame in the second direction;

the wire rope and the lifting motor as well as the movable pulley are provided correspondingly in one-to-one relation, and the wire rope have a first end and a second end; and the first end of the wire rope is wound on an output end of a corresponding lifting motor, and the second end of the wire rope is wound on a corresponding movable pulley.

2. The vehicle frame according to claim 1, wherein each lifting assembly includes two fixed pulleys corresponding to the wire rope;

the two fixed pulleys are disposed opposite to each other in the second direction and between the two lifting motors, and the two fixed pulleys are both rotatably disposed on the upper vehicle frame;

the second ends of the two wire ropes respectively pass around corresponding movable pulleys and corresponding fixed pulleys sequentially and the second ends of the two wire ropes are joined together.

3. The vehicle frame according to claim 2, wherein a tension sensor is provided on the two wire ropes joined together, and the tension sensor is disposed between the two fixed pulleys.

4. The vehicle frame according to claim 1, wherein an output shaft of each of the lifting motors is fixedly provided with a reel, and the first end of the wire rope is wound around the reel of a corresponding lifting motor.

5. The vehicle frame according to claim 1, wherein the locking device includes:

a rotary pin;

a locking head, fixedly provided on a head of the rotary pin;

a rotary handle fixedly disposed on a bottom of the rotary pin, the rotary handle being formed with a first limit face and a second limit face spaced apart from each other on its periphery;

a lifting pin, a central axis of the lifting pin and a central axis of the rotary pin being parallel with each other, the lifting pin operably moving up and down along the central axis of the lifting pin, and the lifting pin being provided with a support protrusion thereon;

a limit block fixedly provided on a bottom of the lifting pin, the limit block being operably engaged with the first limit face or the second limit face;

a reset spring, the reset spring being fitted on the lifting pin, and the reset spring being disposed between the support protrusion and the limit block;

a driving mechanism, an output end of the driving mechanism being connected to the rotary handle, and the rotary handle being able to be rotated by operating the driving mechanism;

wherein the upper vehicle frame includes a first cover plate, the first cover plate being located at a bottom of the upper vehicle frame, the first cover plate being formed with a lock hole, the locking head of the locking device being rotatable in the lock hole;

the lower vehicle frame includes a second cover plate and a partition spaced apart from each other, and the second cover plate and the partition are fixedly connected to each other;

the second cover plate is located at the top of the lower vehicle frame, and the partition is located below the second cover plate;

each of the second cover plate and the partition is formed with a first through hole corresponding to the rotary pin of the locking device, and the rotary pin is fixedly passing through corresponding first through holes in the second cover plate and the partition;

the rotary handle is located below the partition;

the second cover plate and the partition each are formed with a second through hole corresponding to the lifting pin of the locking device;

the lifting pin is extendable and retractable in the second through holes in the second cover plate and the partition, and the reset spring is disposed between the support protrusion and the partition.

6. The vehicle frame according to claim 5, wherein a locking seat and a carrying table are separately provided on the rotary pin, and the locking seat and the carrying table are sequentially disposed between the locking head and the rotary handle;

a first gap is formed between the locking head and the locking seat, and the second cover plate is clamped in the first gap;

a second gap is formed between the carrying table and the rotary handle, the partition being clamped in the second gap, and the locking seat and the carrying table are fitted with each other with spherical surfaces.

7. The vehicle frame according to claim 5, wherein the locking device further includes a sleeve, and the sleeve is fixedly disposed at a bottom of the partition; and the lifting pin is extendable and retractable in the sleeve, and the limit block is located under the sleeve.

8. The vehicle frame according to claim 1, wherein the lower vehicle frame includes a second longitudinal beam, a third cross beam and a fourth cross beam;

central portions of the third cross beam and the fourth cross beam are fixed on the second longitudinal beam, and there are two third cross beams and two fourth cross beams opposite to each other;

the two fourth cross beams are located at two ends of the second longitudinal beam, and the two third cross beams are located between the two fourth cross beams;

the guide device includes a first guide plate, a second guide plate, and a third guide plate;

each of the third cross beams and the fourth cross beams is provided with the first guide plates opposite to each other at two ends thereof, and the two first guide plates on each of the third cross beams and the fourth cross beams are disposed transversely;

guide surfaces of the two first guide plates on each of the third cross beams and the fourth cross beams face each other;

each of the third cross beams is provided with the second guide plate, and the second guide plates on two third cross beams are opposite to each other along the longitudinal direction;

guide surfaces of the second guide plates on two third cross beams face each other, and the second guide plate is foldably connected to the third cross beam;

there are two third guide plates, and the two third guide plates are disposed at two ends of the second longitudinal beam and are opposite to each other; and guide surfaces of the two third guide plates face each other, and the third guide plate is extendable and retractable in a length direction of the second longitudinal beam.

9. An aerial transportation vehicle comprising a vehicle frame according to claim 1.

10. An aerial rail container transportation method implemented with the aerial transportation vehicle according to claim 9, the method comprising:

the aerial transportation vehicle being free of load and running to a certain position and stopping, so that the container is located directly below the aerial transportation vehicle;

operating the lifting assembly to separate the upper vehicle frame from the lower vehicle frame and lowering the lower vehicle frame to a preset height;

completing the locking of the lower vehicle frame with the container;

operating the lifting assembly to make the lower vehicle frame and the container to rise as a whole;

operating the locking device to lock the upper vehicle frame and the lower vehicle frame; and the aerial transportation vehicle being started for transportation after the container assembly process is completed.

* * * * *